United States Patent [19]

Nebgen

[11] 4,207,748

[45] Jun. 17, 1980

[54] HEAT EXCHANGE DEVICE AND METHOD

[76] Inventor: William H. Nebgen, 48-24 43rd St., Woodside, N.Y. 11377

[21] Appl. No.: 771,002

[22] Filed: Feb. 22, 1977

Related U.S. Application Data

[63] Continuation-in-part of Ser. No. 394,971, Sep. 7, 1973, abandoned, which is a continuation-in-part of Ser. No. 886,312, Dec. 16, 1969, abandoned, which is a continuation of Ser. No. 808,368, Mar. 11, 1969, abandoned, which is a continuation of Ser. No. 660,539, Jun. 22, 1967, abandoned, which is a continuation-in-part of Ser. No. 602,214, Dec. 16, 1966, abandoned.

[51] Int. Cl.[2] ..... F25B 1/00

[52] U.S. Cl. ..... 62/115

[58] Field of Search ..... 62/115, 399, 499; 165/105

[56] References Cited

U.S. PATENT DOCUMENTS

| | | | |
|---|---|---|---|
| 2,278,226 | 3/1942 | Taylor | 62/399 |
| 2,813,698 | 11/1957 | Lincoln | 165/105 X |
| 2,867,097 | 1/1959 | Justice | 62/499 X |
| 3,332,253 | 7/1967 | Alexander | 62/499 |

*Primary Examiner*—Lloyd L. King

*Attorney, Agent, or Firm*—Bierman & Bierman

[57] ABSTRACT

Hot brine supplies the heat for a power cycle which produces the power for a refrigeration cycle in which brine at ambient temperature is cooled to sub-ambient temperature. Both cycles use a heat engine whose compressor and expander employ liquid pistons operating in cylinders which consist of multi-turn helically wound conduits whose cross-sections are varied suitably throughout their length. The liquid pistons are the liquid phase of a two phase working fluid, and the engine operates entirely within the wet region of the working fluid. The hot brine preferably is heated by a source of waste heat. A preferred form of the power cycle consists, in sequence, of a non-adiabatic compression step; an adiabatic compression step; a non-adiabatic expansion step; an adiabatic expansion step; and a condensing step. Simpler versions are possible, but at a sacrifice of flexibility or performance. A preferred form of the refrigeration cycle consists of a thermodynamically reversible, non-adiabatic expansion step, a thermodynamically irreversible insenthalpic expansion step, a thermodynamically reversible non-adiabatic heat absorbing compression step, a thermodynamically irreversible isenthalpic expansion step, and a thermodynamically reversible non-adiabatic heat recycling expansion step. Simpler versions are possible, but at a sacrifice of flexibility or performance.

13 Claims, 10 Drawing Figures

27°
9°
0.145
15°
VANES
FINS
TUBE NEST
TUBE NESTS
COLD BRINE OUT

HEAT EXCHANGE DEVICE AND METHOD

This application is a continuation-in-part of my copending application Ser. No. 394,971, filed Sept. 7, 1973, now abandoned, which is a continuation-in-part of application Ser. No. 886,312, filed Dec. 16, 1969, now abandoned, which is a continuation of application Ser. No. 808,368, filed Mar. 11, 1969, now abandoned, which is a continuation of application Ser. No. 660,539, filed June 22, 1967, now abandoned, which in turn is a continuation-in-part of copending application Ser. No. 602,214, filed Dec. 16, 1966, now abandoned.

This invention relates to a heat engine, a refrigeration cycle and a power cycle.

Almost all modern brine chilling installations use a Rankine refrigeration cycle, which also is known as a vapor compression cycle. In its simplest form, this cycle consists of an adiabatic expansion step, in which liquid refrigerant is flashed through an expansion valve to a lower temperature and pressure; an isothermal vaporizing step, in which the remaining liquid is vaporized by heat which is removed from the brine that is being cooled; an adiabatic compression step, in which all the vapor is compressed to condensing pressure; and an isothermal condensing step, in which all the vapor is condensed, and in which there is rejected to the heat sink the heat of compression and the heat that was removed from the brine.

In order for heat transfer to occur, the liquid vaporizing step is at a lower temperature than the final desired brine temperature, and all the refrigeration is provided at that temperature level, even though the initial temperature of the brine may be considerably higher.

To conserve power, the refrigeration sometimes is performed in two stages, in which the brine is cooled in two steps, using two Rankine cycles in series, but this is quite expensive. The minimum power is consumed when a large number of stages is used, but this procedure is prohibitively expensive and complicated.

The present invention provides the equivalent of a very large number of refrigeration stages, and with a simple and economical apparatus cools the brine with minimum expenditure of power.

It is expensive and thermally inefficient to convert to useful work the relatively low level waste heat such as that contained in a stack gas. When the expense can be justified, the classical procedure is to install a waste heat boiler, and to produce work from the steam that is generated. When the temperature of the stack gas is low, the boiler and associated equipment are large, cumbersome and costly. The temperature of the stack gas leaving the boiler must be higher than the temperature of the steam that is generated, and most of the heat content of the stack gas between the temperature of the boiler and the temperature of the heat sink is lost. This loss can be reduced to a minimum by providing a large number of waste heat boilers in series, but the cost and complexity of such a system is prohibitive.

The instant invention simply and economically provides the equivalent of a very large number of boilers, in series, and with a practical apparatus produces the maximum possible amount of power from a stack gas at any given temperature.

The present invention will now be explained in greater detail with reference to the attached drawings wherein:

FIG. 1(*b*) is a generalized temperature-entropy diagram for R22 exaggerated to better show the pertinent aspects of a power cycle according to the invention;

Figure 1A:
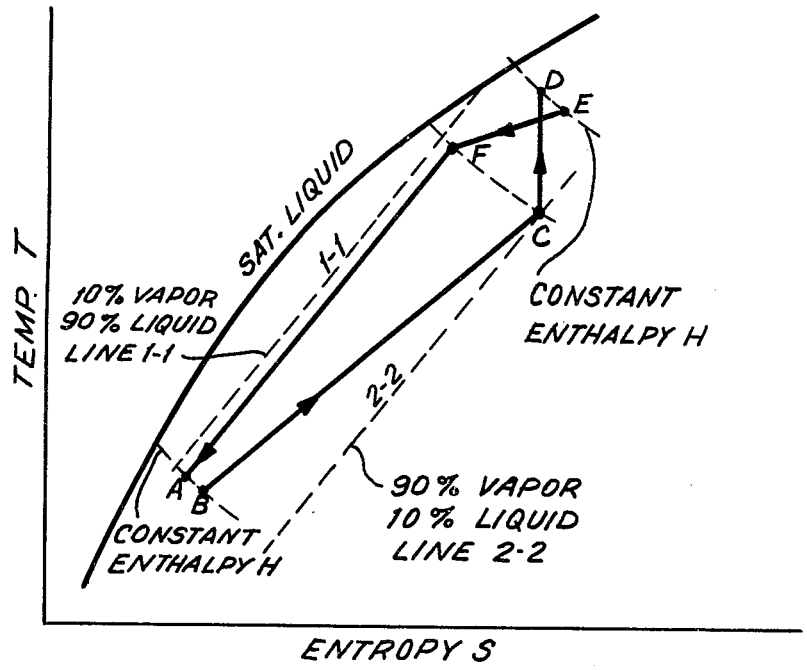
FIG. 1(*a*) is a generalized temperature-entropy diagram for R22 exaggerated to better show the pertinent aspects of a refrigeration cycle according to the invention.

As stated heretofore, this invention concerns a heat engine, a refrigeration cycle, and a power cycle.

In the engine, the liquid phase and the vapor phase of a two-phase working fluid are always in direct contact, and the engine operates at all times within the wet region of the working fluid. In this region, the temperature of the saturated vapor is the same as the temperature of its contacting saturated liquid, and the pressure of the fluid is uniquely determined by its temperature. In the engine there is employed an expander having liquid pistons and a compressor having liquid pistons. The pistons are composed of the liquid phase of the working fluid, and operate in cylinders which are formed from two multi-turn helically wound conduits, concentrically disposed about a common horizontal axis. The outer helix is of opposite hand to the inner helix, and the outer conduit is connected to the inner conduit at both ends, thus forming a continuous closed loop. In this description, the word "cylinder" is not used in its geometric sense, but denotes a container within which a piston operates. The cross section of this cylinder varies throughout its length.

The liquid pistons are formed when each turn of each helix is partially filled with liquid phase working fluid. The remaining volume of each turn is occupied by the vapor phase of the same fluid, so that a pocket of vapor is trapped between two successive pistons.

When the two helices are rotated about their common horizontal axis, the liquid pistons in the inner helix are screwed in a direction parallel to the axis of rotation, and carry with them the trapped pockets of vapor. When each piston reaches the end of the inner helix, it passes through the connecting end conduit and through an expansion valve to the start of the outer helix. Because of the difference in hand, the piston then is screwed in the opposite axial direction until it reaches the end of the outer helix, where it passes through the connecting end conduit and through an expansion valve to the start of the inner helix.

The inner helical conduit in general is a compressor, and the outer helical conduit in general is an expander. The pressure of the working fluid at the end of the inner helix is greater than that at the start. Each turn of the helix provides a portion of the total pressure rise, so that the pressure in the third turn is greater than that in the second, and so on.

In each turn, one side of the piston is in contact with a higher pressure vapor than is the other side, and as in a manometer, the liquid level is higher in the low pressure leg. The pressure rise in each turn is the result of the liquid head, which is the difference in the height of the liquid legs. The total pressure rise is the sum of the liquid heads of all the turns. The pressure rise corresponding to a given liquid head is greatly enhanced by rotatably mounting the two helices in a carrying cage which is rotated about its own parallel axis, thus subjecting the liquid head to a centrifugal force which may be many times that of gravity. For balancing purposes, and to conserve space, a number of pairs of helices are rotatably mounted in the same carrying cage.

When a unit weight of a two phase working fluid is contained in a given volume, at equilibrium the relationship of liquid weight to vapor weight is uniquely determined by the temperature of the fluid. An increase in temperature increases the weight of vapor and decreases the weight of liquid. This change in weight ratio requires vaporization of a portion of the liquid, and sufficient heat must be provided to not only raise the temperature of the fluid, but to supply for the liquid thus vaporized the latent heat of vaporization as well. The heat must be available at a temperature sufficiently above the temperature of the working fluid so that heat transfer can occur. Although the total volume occupied by the liquid and the vapor is unchanged, the ratio of liquid volume to vapor volume decreases. Because of the very large difference in density of the liquid and the vapor, a relatively small change in liquid volume results in a large change in the weight ratio of liquid to vapor.

When the unit weight of two phase fluid is compressed adiabatically into a smaller volume, the pressure of the vapor becomes higher than the equilibrium pressure at the initial temperature. Vapor condenses in the remaining liquid, raising its temperature until a new equilibrium is established.

When the volume reduction is performed nonadiabatically, and the latent heat of condensation is removed during the operation, the reduction in volume takes place isothermally and isobarically. The path of the nonadiabatic reduction in volume can be varied at will by removing only a part of the latent heat of condensation.

When the unit weight of two phase fluid is expanded adiabatically into a larger volume, its vapor pressure becomes lower than the equilibrium pressure at the initial temperature. A portion of the liquid vaporizes, lowering the temperature of the remaining liquid until a new equilibrium is established. If the volume expansion is performed nonadiabatically, and the latent heat of vaporization is added during the operation, the expansion in volume takes place isothermally and isobarically. The path of the nonadiabatic expansion in volume can be varied at will by adding only a part of the heat that is required to vaporize this portion of liquid.

When the liquid piston engine is used in a refrigeration cycle to cool brine, the cycle consists of a thermodynamically reversible, nonadiabatic expansion step; a thermodynamically irreversible isenthalpic expansion step, a thermodynamically reversible nonadiabatic heat absorbing compression step; a thermodynamically reversible adiabatic compression step; a thermodynamically irreversible isenthalpic expansion step, and a thermodynamically reversible nonadiabatic heat rejecting expansion step. The working fluid in the nonadiabatic compression step countercurrently absorbs heat from the brine, and from the working fluid in the nonadiabatic expansion step as well. The net refrigerating effect is the cooling of the brine.

During the thermodynamically reversible nonadiabatic expansion step, heat is gradually rejected from the working fluid, at progressively lower temperatures, and the temperature and the pressure of the working fluid gradually decrease. The total volume occupied by the two phase fluid is adjusted gradually to provide throughout the step a desired ratio of liquid volume to vapor volume.

During the irreversible isenthalpic expansion step, the fluid passes through a variable orifice expansion valve which maintains a constant pressure differential across it, and the temperature and pressure of the fluid decreases.

During the thermodynamically reversible nonadiabatic compression step, a portion of the liquid phase gradually is vaporized as the working fluid gradually warms up on gradually absorbing heat from the brine and from the fluid in the nonadiabatic expansion step. The total volume occupied by the fluid gradually is increased, and is adjusted to provide throughout the step the desired ratio of liquid volume to vapor volume. The temperature of the working fluid throughout this compression step is sufficiently below the temperature of the brine and of the temperature of the fluid in the nondiabatic expansion step to permit heat exchange to occur.

During the adiabatic compression step, the two phase working fluid is thermally isolated, the total volume it occupies gradually is reduced, and its temperature rises.

During the isenthalpic expansion step, the fluid passes through a variable orifice spring loaded expansion valve which maintains a constant, preset pressure drop across it. The pressure and the temperature of the fluid both decrease.

During the heat rejecting expansion step, the total volume occupied by the two phase working fluid gradually is reduced, heat gradually is rejected to the heat sink, and a suitable portion of the vapor phase condenses so as to provide at the end the desired ratio of liquid volume to vapor volume.

The total volume occupied by a unit weight of a two phase working fluid is the sum of the liquid phase volume and the vapor phase volume. Because of the large difference in the density of the liquid and the vapor, the total volume occupied by the unit weight is a minimum when the vapor phase volume is minimum, and is a maximum when the vapor phase volume is maximum. When liquid pistons operate in a helically wound cylinder, the vapor volume is the volume of the cylinder between the high pressure side of one piston and the low pressure side of the adjacent piston. As in a manometer, the low pressure side of the piston is at a higher elevation than the high pressure side. The highest level that the liquid on the low pressure side can reach occurs when the liquid is on the verge of spilling over the top into the next turn. The minimum vapor volume possibly is the volume of the cylinder between this level and the level of the high pressure side of the piston in the next turn. The lowest level that the liquid on the high pressure side can reach occurs when the liquid barely seals the bottom of the turn. The maximum vapor volume possible is the volume of the cylinder between this level and the level of the low pressure side of the piston in the next turn.

At the start of the isenthalpic expansion step, the total volume is the minimum that is possible, and the vapor volume is the minimum that is possible. During this expansion step, the vapor volume increases, and the temperature and the pressure of the working fluid decrease.

At the start of the nonadiabatic compression step, the total volume, the temperature, and the pressure are the same as at the end of the isenthalpic expansion step.

During the nonadiabatic compression step, the volume of the cylinder gradually is increased until at the end of the step the total volume occupied by the two phase working fluid is the maximum possible, the vapor volume is the maximum possible, and the temperature, pressure, and density of the vapor are higher than at the start. At the end of the step, the weight of vapor is greater than at the start, and the weight of the liquid is correspondingly less. The heat that is required to vaporize the additional liquid comes from countercurrently cooling the brine, and from countercurrently cooling the working fluid in the nonadiabatic expansion step. The latter is an internal recycle, which is necessary for the operation of the liquid piston engine, but which does not contribute to cooling the brine. The nonadiabatic expansion step occurs at almost constant total volume, and cooling its two-phase working fluid requires mostly the removal of sensible heat. The vaporization of a small portion of the liquid in the nonadiabatic compression step is sufficient to cool, through a large temperature range, all the working fluid in the nonadiabatic expansion step. The remainder of the cooled expendable liquid in the nonadiabatic compression step is used to produce an external refrigeration effect by cooling the brine.

When the engine is used in a power cycle, the steps of the cycle consist, in sequence, of a thermodynamically reversible nonadiabatic compression step; a thermodynamically reversible nonadiabatic expansion step; a thermodynamically reversible heat rejection step and an isenthalpic expansion step. As would be expected from basic thermodynamics, this cycle is very similar to the refrigeration cycle, except that the sequence of steps is reversed. The previous explanations, comments, and constraints applying to the refrigeration cycle also apply to the power cycle.

When the heat engine is used in a power cycle, its supply of heat most advantageously comes from a hot brine, which on surrendering its heat in the cycle is cooled to almost the temperature of the heat sink. Although the brine may be heated in any way desired, it is most suitably heated by a source of waste heat whose temperature is too low to permit its economical use in other heat recovery systems.

Referring now to the drawings. As stated heretofore, FIGS. 1(*a*) and 1(*b*) are exaggerated temperature-entropy diagrams for R22. In the wet region, pressure varies with temperature.

It was explained earlier that proper functioning of the liquid pistons precludes operating with a liquid level above the described maximum or below the described minimum. With a particular configuration, which will be explained later, the maximum volume the liquid can occupy is about 90% of the total volume, and the minimum volume the liquid can occupy is about 10% of the total. On FIGS. 1(*a*) and 1(*b*), line 1—1 is the locus of points of maximum liquid volume, and line 2—2 is the locus of points of minimum liquid volume. The liquid pistons operate satisfactorily in the region between these two lines.

Figure 1B:
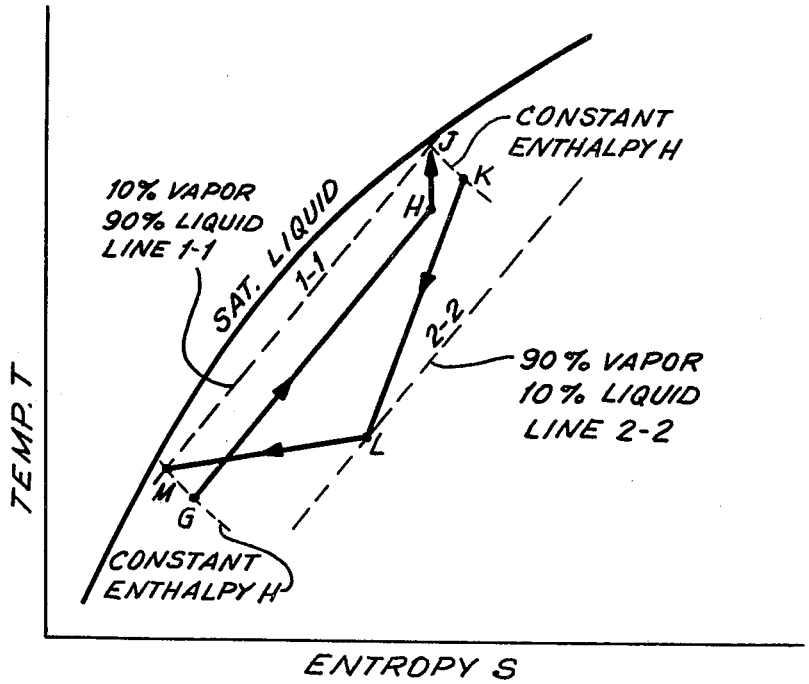

On FIG. 1, the refrigeration cycle is shown as A-B-C-D-E-F-A.

For Refrigerant R-22:

| | | | | | |
|---|---|---|---|---|---|
| At point | A, T = 8° F., | P = 47.73, | V = 0.0134, | H = 12.636, | S = 0.0283 |
| | B, T = 5° F., | P = 43.03, | V = 0.0284, | H = 12.636, | S = 0.02835 |
| | C, T = 86° F., | P = 174.4, | V = 0.09871, | H = 58.09, | S = 0.1145 |
| | D, T = 96° F., | P = 201.1, | V = 0.098, | H = 58.6, | S = 0.1145 |
| | E, T = 95° F., | P = 198.3 | V = 0.086, | H = 58.6, | S = 0.11456 |
| | F, T = 86° F., | P = 174.4 | V = 0.01507 | H = 36.517 | S = 0.0748 |

T is the temperature in degrees Fahrenheit, P is the pressure in psia, V is the specific Volume in cu. ft. per lb., H is the specific enthalpy in BTU per lb. per degree F.

During isenthalpic expansion step A-B, the fluid passes through a variable orifice, constant pressure drop expansion valve and the volume of the fluid increases. Since the expansion occurs through a valve, the process is isenthalpic and thermodynamically irreversible, so that the entropy increases while the temperature and the pressure decrease.

During nonadiabatic compression step B-C, the specific volume of the fluid increases gradually, and the temperature, pressure, enthalpy, and entropy also increase. In this step, 43.55 BTU of heat is absorbed, 23.56 BTU from the fluid in F-A, and 19.98 from the brine. The latter is the net refrigeration effect of the cycle. The temperature at B is 3° lower than the temperature at A. This temperature difference is an internal requirement and is not necessarily the temperature difference between the brine and the working fluid in B-C.

During adiabatic compression step C-D, the volume gradually decreases, the temperature, enthalpy and pressure increase, while the entropy remains constant. This adiabatic compression step raises the temperature of the working fluid to a level sufficiently high to permit heat transfer with and rejection to the fluid of the heat sink.

During isenthalpic expansion step D-E, the fluid passes through a spring loaded, variable orifice, constant pressure drop expansion valve. The pressure and temperature of the fluid both decrease. This variable orifice constant pressure drop valve permits the fluid to change from a compression step to an expansion step and also accommodates the cyclic shift from vapor to liquid to vapor.

During heat rejection step E-F, the volume, pressure, temperature and entropy gradually decrease. During this step, 21.9 BTU is rejected from the cycle to the heat sink. Since only 19.98 BTU has been absorbed in cooling the brine from 86° to 5°, 1.92 BTU has been supplied in the form of work.

The coefficient of performance, which is the ratio of refrigeration effect to work input, is about 10.4. At the same evaporator and condenser temperatures, 5° and 86°, respectively, a Rankine cycle has a coefficient of performance of about 4.6.

In the cycle of the invention, about 740 lbs. of refrigerant R22 is circulated per ton of refrigeration. This is about twice that of the Rankine cycle, but in this invention the refrigerant is mostly liquid phase, so the volumetric circulation is only a fraction of that of the Rankine cycle.

On FIG. 1(*b*), the power cycle is shown as G-H-J-K-L-M-G.

| | | | | | |
|---|---|---|---|---|---|
| At point | G, T = 86° F., | P = 174.5, | V = 0.0191, | H = 38.034, | S = 0.0776 |
| | H, T = 144° F., | P = 372.3, | V = 0.0205, | H = 57.99, | S = 0.1111 |
| | J, T = 150° F., | P = 399.2, | V = 0.0175, | H = 58.05, | S = 0.1111 |
| | K, T = 147° F., | P = 385.6, | V = 0.0191, | H = 58.05, | S = 0.1116 |
| | L, T = 92° F., | P = 190.1, | V = 0.0963, | H = 61.05, | S = 0.1193 |
| | M, T = 89° F., | P = 182.1 | V = 0.0152, | H = 38.034, | S = 0.0776 |

During nonadiabatic compression step G-H, the temperature, pressure, volume, enthalpy, and entropy of the fluid gradually increase.

During compression step H-J, the volume of the fluid decreases gradually, its entropy remaains constant, and its temperature, pressure aand enthalpy increase. From the reversible path equation, 0.04 BTU of work is consumed. The increase in temperature from H to J is required so as to permit heat to be transferred countercurrently from K-L to G-H. From J-K, the fluid undergoes isenthalpic irreversible expansion through an expansion valve which will be explained in greater detail below.

During nonadiabatic expansion step K-L, the specific volume of the fluid increases, and its temperature, pressure, enthalpy, aand entropy decrease. From the reversible path equation 2.37 BTU of work is produced.

During heat rejection step L-M, the volume, entropy, temperature and enthalpy of the fluid gradually decrease. The decrease in volume occurs as a result of condensing a portion of the vapor. In this step, if so desired, the temperature and pressure may vary over a range, and depending on the path selected, work may be produced or consumed.

The total addition of heat in step G-H is 19.26 BTU, of which 4.26 BTU comes from step K-L. The remainder comes from the hot brine whose temperature must be sufficiently higher than 150° to permit heat transfer to G-H to occur. The quantity of hot brine per lb. of refrigerant fluid is determined by the heat requirement per lb. of power fluid and by the number of lbs. of power fluid circulated per lb. of refrigerant fluid. If the hot brine is available at a temperature higher than 150°, a smaller quantity can provide the heat that is necessary for the power cycle. However, when the brine is hotter than the power fluid, thermodynamically the cycle is less efficient because of the irreversibility of the heat exchange between the brine and the fluid. It is therefore advantageous to select a power fluid whose characteristics match more exactly the properties of the hot brine. The power fluid may or may not be the same fluid as is used in the refrigeration cycle.

When the source of heat is at a lower temperature, it is possible to use a larger quantity of hot brine to cool a smaller quantity of cold brine by withdrawing aat point M a portion of the hot brine that has given up its heat in the cycle.

It also is possible to use two entirely different brines for the refrigeration and for the power cycle.

The theoretical descriptions of the cycle have called for adiabatic expansion and compression steps, both in the power cycle and in the refrigeration cycle. In practice, such specific steps may be unnecessary, since one of the requirements for practical heat transfer is for a temperature difference to exist. This temperature difference might permit the higher temperature fluid to transfer heat to the lower temperature fluid at points that may be only slightly displaced from theoretical. The simplest form of the invention therefore could employ a nonadiabatic, nonisothermal compression step, or a nonadiabatic, nonisothermal expansion step, or a combination of both.

Figure 2:
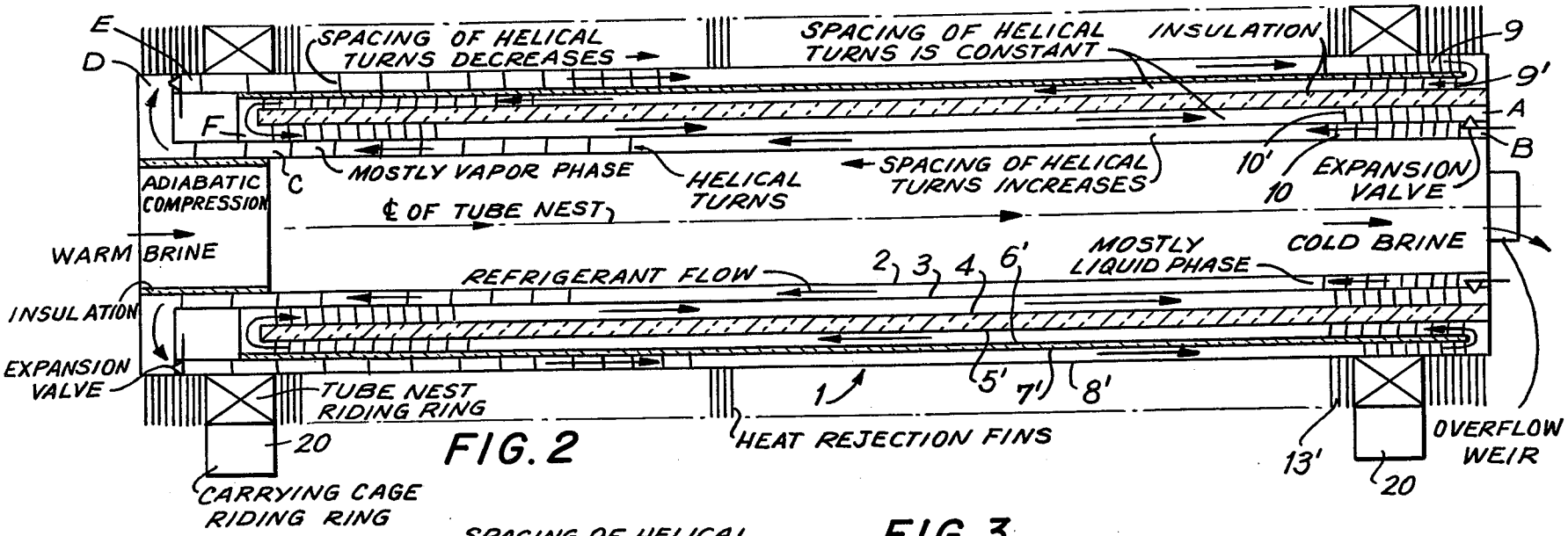
FIG. 2 is a longitudinal cross section of a tube nest used in the refrigeration cycle.
Figure 3:
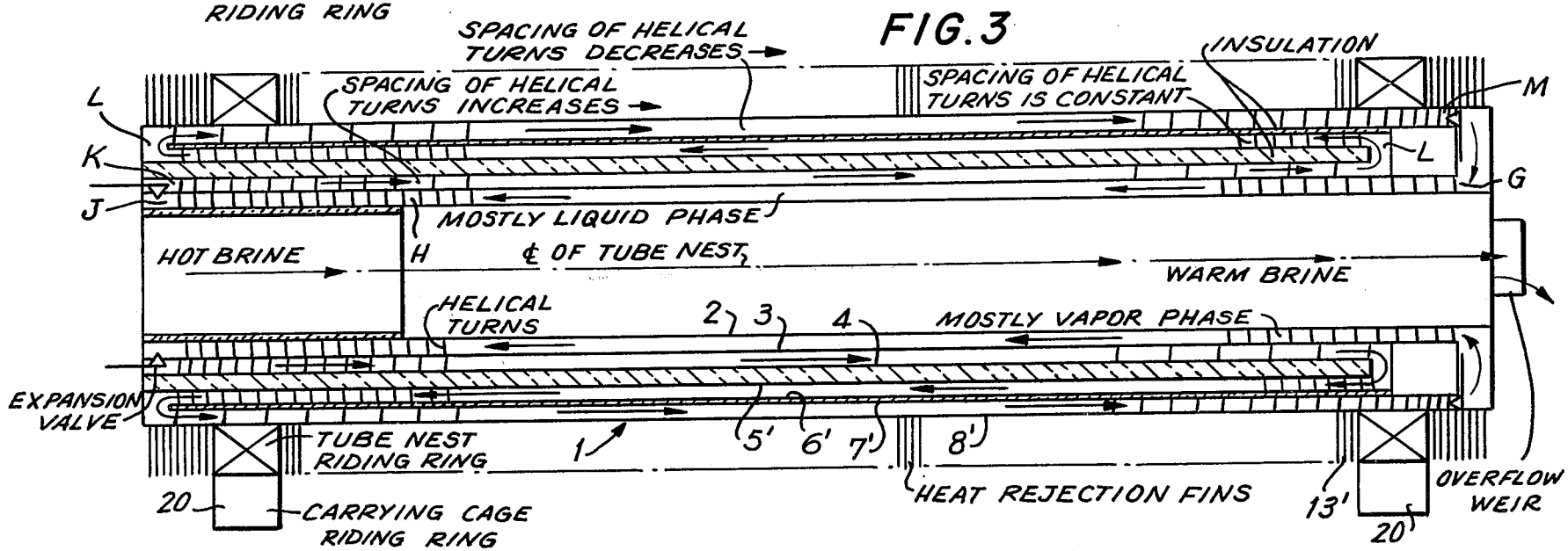
FIG. 3 is a view similar to FIG. 2 of a tube nest used in the power cycle.
Figures 4, 5, 6, 7, 8, 9:
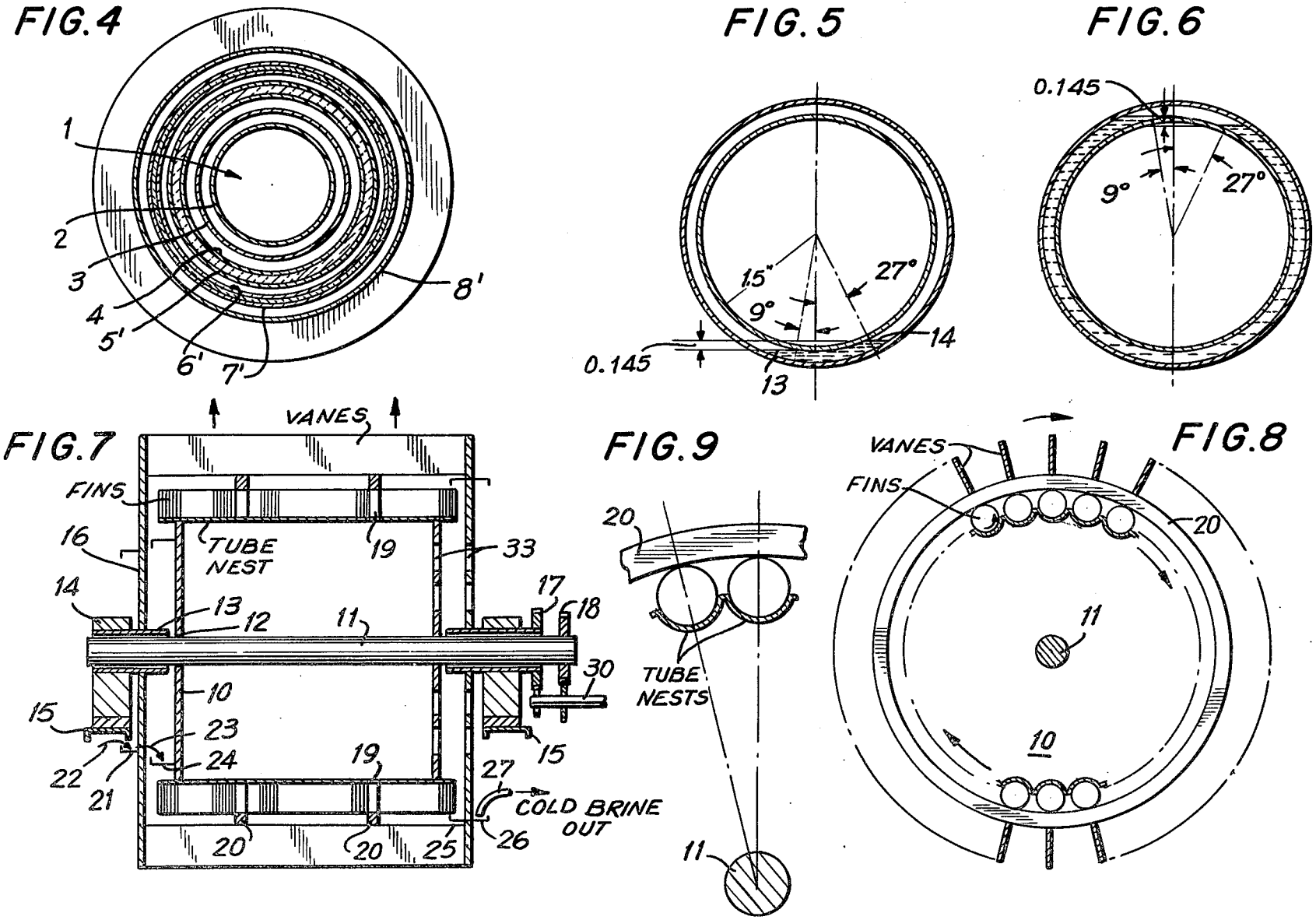
FIG. 4 is a cross section of the tube nest.
FIG. 5 is a cross section of a tube having 90% vapor and 10% liquid therein.
FIG 6 is a cross section of a tube having 10% vapor and 90% liquid therein.
FIG. 7 is a sectional elevation of a brine chilling apparatus.
FIG. 8 is a side view of the brine chilling apparatus of FIG. 7.
FIG. 9 is an enlarged detail view of the drive supports for the tube nest.

Referring now to FIGS. 2–4. As stated heretofore, FIG. 2 is a longitudinal section of a tube nest 1 used in the refrigeration cycle, FIG. 3 is a similar view of a tube nest 1 used in the power cycle, and FIG. 4 is a typical cross section of tube nest 1, which consists of seven concentric tubes 2, 3, 4, 5', 6', 7' and 8'. In FIG. 2, a continuous helically wound right hand pitch divider strip 9 separates tubes 8' and 7', and a similar left hand pitch divider strip 10 separates tubes 2 and 3. Divider strip 9' separates tubes 5' and 6' and divider strip 10' separates tubes 3 and 4. Divider strip 9 and the annular space between tubes 7' and 8' provide the compression cylinder, and divider strip 10 and the annular space between tubes 3 and 2 provide the expansion cylinder. Divider strips 9 and 10 may conveniently by made of wire of a suitable diameter, suitably attached to tubes 2, 3 and 4 to form a reasonably tight closure.

The tube nest shown in FIG. 3 is of the same construction as that employed for the tube nest shown in FIG. 2. Since the same number of tubes is used, the numerals employed are the same as in FIG. 2.

Points A, B, C, D, E and F on FIG. 2, G, H, J, K, L and M identify the corresponding cycle points of FIGS. 1 and 2. On FIG. 2, F is shown at two places. The fluid state at each point is identical.

On FIG. 2, the helical turns of divider strips 9, 9', 10 and 10' are suitably spaced so as to give the volumetric relationships previously described. The spacing of the turns increases between B and C, and decreases between C and D. At D a spring loaded variable orifice expansion valve is provided to permit the working fluid to pass from the inner cylinder to the outer cylinder. The spacing of the helical turns of divider strip 9 decreases between E and F and is almost constant between F and A. At the other end of the tube nest a spring loaded variable orifice expansion valve is provided to permit the working fluid to pass from the outer cylinder to the inner cylinder. The annular fluid conducting spaces between the tubes are of course sealed at the ends.

The warm brine enters tube 2 at 11, and is cooled as it flows from left to right, leaving tube 2 at 12. The working fluid in the annular space between tubes 2 and 3, flowing from right to left, countercurrently and gradually removes heat from the brine, and similarly removes heat from the working fluid in F-A of the annular space between tubes 3 and 4, which is flowing from left to right.

The inside of tube 2 is suitable insulated between C and D so as to isolate the working fluid from the brine.

The heat that is removed from the brine in step B-C, plus the heat of compression, is rejected to the atmosphere in step E-F, where fins 13 are attached to tube 8' to facilitate countercurrent heat rejection to the air, if so desired.

With the power cycle tube nest FIG. 3, the spacing of the helical turns increases between G and H and decreases between H and J. At J a variable orifice is provided to permit the working fluid to pass from the inner cylinder to the outer cylinder. The spacing of the turns decreases from L to M. At M a variable orifice permits the working fluid to pass from the outer cylinder to the inner cylinder.

As before, insulation is applied to the inside of center tube 2 between J and K and between M and G, and cooling fins 13' are attached to the outer tube between L and M.

Hot brine enters tube 2 at the left as viewed in FIG. 3, and gradually and countercurrently, gives up heat to the working fluid in step K-M, and leaves tube 2 at the right as viewed in FIG. 3. A portion of the heat supplied by the hot brine is converted to work, and the remainder of the heat is rejected in step L-M.

FIG. 5 shows one of a number of possible practical configurations of tubes. Only two tubes are shown, since they are sufficient to illustrate the point. For maximum vapor volume, shown as line 2—2 in FIGS. 1(*a*) and 1(*b*), point 13 is the lowest possible liquid level, which for the tube size and annular spacing selected, corresponds to a center angle of about 9°. Point 14 is determined by the center angle of 27°, and results in a liquid leg of about 0.145". The two center angles add up to 36°, which is, of course, one tenth of the circle for the liquid, and nine-tenths of the circle for the vapor.

FIG. 6 shows the same selected tube configuration, except that the position of the liquid levels produces maximum liquid volume, which constitutes nine-tenths of the circle, with the vapor occupying one-tenth of the circle. This shows as line 1—1 on FIG. 1.

For the dimensions and operating conditions selected, if about 30 turns are used in compression step B-C, the pressure rise produced by the sum of the liquid legs will equal the increase of vapor pressure of the working fluid if the tube is subjected to a centrifugal force which produces aabout 700 gees.

About 5 axial feet of tube in B-C, and about 5 axial feet of finned tube in E-F can provide sufficient heat transfer surface for five tons of refrigeration.

At point B, the liquid-vapor volume relationship very nearly corresponds to FIG. 6, and at point C the relationship very nearly corresponds to FIG. 5.

FIGS. 7–9 depict a brine chilling apparatus, useful in carrying out the cycle discussed above. Tube nest drive plate 10 is driven by shaft 11 which rotates in bearings 12 in rotatable sleeves 13, sleeves 13 in turn rotate in bearings 14 which are fastened to stationary frame 15. Carrying case 16 is fastened to sleeves 13 and rotates in the sleeve 13. Sleeves 13 and shaft 11 are driven at slightly different robative speeds by means of conventional gears 17 and 18 which are driven by conventional mating gears from a drive shaft 30.

When tube drive plate 10 is rotated, carrying case 16 will also rotate in the same direction, but at a slightly slower speed, so that solid rings 19, fastened to the tube nests, will run in riding rings 20, which are fastened to fan impeller vanes 32 which also form the cross brace members of the carrying case 16. The tube nests will rotate in the opposite direction to the carrying case 16. The frictional load that is imparted to the tube nests is by this means confined to the driving force only, and the very large load imposed by centrifugal force is carried not by the bearings, but by the rolling action of rings 19 on riding rings 20, thus insuring the continuing integrity of the apparatus.

Warm brine is introduced into ring 21 by stationary tube 22, and flows through tube 23, attached to carrying cage 16, to distribute ring 24, attached to tube nest drive plate 10, from which it is delivered to each tube nest.

Cool brine flows out of each tube nest into discharge ring 25, fastened to carrying case 12, as is discharge ring 26. Holes through carrying case 16 interconnect discharge rings 25 and 26. From discharge ring 26, a slimmer tube 27 delivers the cold brine to its destination. Holes 33 in the right hand side of carrying case 16 permit ambient air to be drawn in and directed over the heat rejection fins of the tube nests. Vanes 28 attached to carrying case 16 act as fan blades to draw the air in, and discharge it to the atmosphere. A volute, (not shown) would be desirable to improve the efficiency of this fan, and baffles, also not shown, would be desirable to direct the cooling air flow countercurrent to the refrigerant flow.

If desired, it is possible to spray water in the heat rejection surfaces as the air flows over them, and thus have them function as evaporative condensers.

Although the apparatus herein disclosed has been described with reference to brine chilling, one skilled in the art will readily appreciate that it could be also employed for other purposes as, for example, direct air-cooling. Furthermore, it is also apparent that the heat exchange device of the present invention could be utilized as a refrigeration device, or as a power supply device depending upon the direction it is run.

When the power cycle is used to provide power for the refrigeration cycle, the tubes, being directly connected, operate at the same RPM, and experience the same number of gees as the refrigeration cycle tubes.

What is claimed is:

1. A method for exchange of heat comprising vaporizing a portion of a body of liquid refrigerant by countercurrent absorption of heat from a material to be cooled to form a liquid always in contact with and substantially undispersed in a vapor phase, compressing both phases and then removing heat from said phases to cause condensation thereof and wherein said phases are compressed during the absorption of heat from the material to be cooled.

2. A method as in claim 1 wherein said compressed phases are in countercurrent flow with a coolant at progressively higher temperatures as said phases are progressively further compressed.

3. A method as in claim 1 wherein said compressed phases are in countercurrent flow with a coolant while the temperature of said phases is decreasing.

4. A method as in claim 1 wherein there is countercurrent cooling of the liquid phase of said refrigerant in an expansion helix by a refrigerant in a compression helix, said helixes forming a continuous loop.

5. A method according to claim 1 which comprises providing a sealed closed loop helix containing a heat transfer fluid, contacting one portion of said helix with a cooling fluid, contacting another portion of said helix with fluid to be cooled, rotating said helix about its central axis and revolving said helix about an external axis substantially parallel to said internal axis whereby said heat transfer fluid is caused to circulate between said cooling fluid and said fluid to be cooled within said closed loop helix.

6. A method according to claim 1 wherein the work of compression of said refrigerant is derived in part from expansion of said refrigerant.

7. A method as in claim 1 wherein said phases in the step of removing heat are in countercurrent flow with a coolant while heat is being removed.

8. A method according to claim 1 wherein said liquid phase and said vapor phase are compressed as they flow toward contact with a cooling fluid and expanded as they flow away from said contact with said cooling fluid.

9. A method according to claim 1 wherein the total volume of phases decrease during the step of removing heat.

10. A method for exchange of heat comprising the steps of non-adiabatically expanding a refrigerant fluid having a gaseous phase and a liquid phase, non-adiabatically compressing the fluid, maintaining the gaseous phase continuously in direct contact with the liquid phase, and indirectly and countercurrently transferring heat from the fluid during the non-adiabatic expansion step to the fluid in the non-adiabatic compression step.

11. A method for exchange of heat comprising the steps of vaporizing a portion of a liquid refrigerant by absorption of heat from a material to be cooled to form a single liquid phase and a vapor phase; compressing both said phases; then condensing said phases while cooling, said compressed phases being in countercurrent flow with a coolant at progressively higher temperatures as said phases are progressively further compressed.

12. A method as in claim 11 further comprising the steps of expanding the liquid phase of said liquid refrigerant and cooling said liquid phase by a refrigerant undergoing compression, said expanding and compressing refrigerants being in countercurrent flow, and wherein the liquid refrigerant being cooled is expanded.

13. A method for exchange of heat comprising the steps of vaporizing a portion of a liquid refrigerant by absorption of heat from a material to be cooled to from a single liquid phase and a vapor phase; compressing both said phases; then condensing said phases while removing heat therefrom, there being countercurrent cooling of the liquid phase of said refrigerant.

* * * * *